US007691035B2

(12) United States Patent
Chen et al.

(10) Patent No.: US 7,691,035 B2
(45) Date of Patent: Apr. 6, 2010

(54) ADJUSTABLE ELLIPTICAL EXERCISE MACHINE

(75) Inventors: Ming Nan Chen, Taichung Hsien (TW); Hsuan Fu Huang, Taichung (TW)

(73) Assignee: Michael Lin, Chongsan Chu, Taipei (TW)

( * ) Notice: Subject to any disclaimer, the term of this patent is extended or adjusted under 35 U.S.C. 154(b) by 1 day.

(21) Appl. No.: 12/157,568

(22) Filed: Jun. 11, 2008

(65) Prior Publication Data

US 2009/0312156 A1 Dec. 17, 2009

(51) Int. Cl.
*A63B 22/00* (2006.01)
*A63B 22/04* (2006.01)

(52) U.S. Cl. ..... 482/52; 482/51; 482/57

(58) Field of Classification Search ..... 482/51–53, 482/57, 70, 79–80
See application file for complete search history.

(56) References Cited

U.S. PATENT DOCUMENTS 5,352,169 A 10/1994 Eschenbach ..... 482/57
5,423,729 A * 6/1995 Eschenbach ..... 482/70
5,595,553 A 1/1997 Rodgers, Jr. ..... 482/51
5,823,917 A 10/1998 Chen ..... 482/57
5,868,648 A * 2/1999 Coody et al. ..... 482/54
6,053,847 A 4/2000 Stearns et al. ..... 482/51
6,077,198 A 6/2000 Eschenbach ..... 482/52
6,135,927 A * 10/2000 Lo ..... 482/57
6,190,289 B1 * 2/2001 Pyles et al. ..... 482/52
6,666,796 B1 * 12/2003 MacCready, Jr. ..... 482/51
7,462,135 B2 * 12/2008 Lo ..... 482/52
2007/0238582 A1 * 10/2007 Lee ..... 482/52
2008/0280733 A1 * 11/2008 Dickie et al. ..... 482/52

* cited by examiner

*Primary Examiner*—Steve R Crow
(74) *Attorney, Agent, or Firm*—Charles E. Baxley

(57) ABSTRACT

An elliptical exercise machine includes a frame pivotally attached to a base, a pivotal coupling device pivotally coupling the base and the frame together, a retractable device having an outer tube pivotally coupled to the base, and an inner shaft slidably engaged in the outer tube and pivotally coupled to the pivotal coupling device for allowing the inner shaft to be moved into the outer tube or to be moved out of the outer tube when the frame is pivoted to the base, and a latching device for latching the inner shaft to the outer tube at any selected position and for allowing the elliptical exercise machine to be easily adjusted to different moving strokes and to be easily operated by the user.

10 Claims, 10 Drawing Sheets

ADJUSTABLE ELLIPTICAL EXERCISE MACHINE

BACKGROUND OF THE INVENTION

1. Field of the Invention

The present invention relates to an elliptical exercise machine, and more particularly to an elliptical exercise machine including an adjustable structure for allowing the elliptical exercise machine to be easily adjusted to different moving strokes and for allowing the elliptical exercise machine to be easily operated by the user.

2. Description of the Prior Art

Typical elliptical exercise machines comprise a pair of foot supports pivotally coupled to a supporting base with cranks and slidably attached to the supporting base with wheels or rollers for allowing the elliptical exercise machine to be moved in an elliptical moving stroke.

For example, U.S. Pat. No. 5,352,169 to Eschenbach, and U.S. Pat. No. 5,595,553 to Rodgers, Jr. disclose two of the typical elliptical exercise machines each also comprising a pair of cranks rotatably supported on a supporting base and pivotally coupled to two foot supports which are slidably attached to the supporting base with wheels or rollers for allowing the elliptical exercise machine to be moved in an elliptical moving stroke.

However, the moving strokes of the elliptical exercise machines may not be adjusted to different moving strokes and may not be easily operated by different users.

U.S. Pat. No. 5,823,917 to Chen, U.S. Pat. No. 6,053,847 to Stearns et al., and U.S. Pat. No. 6,077,198 to Eschenbach disclose three further typical elliptical exercise machines each also comprising a pair of cranks rotatably supported on a supporting base and pivotally coupled to two foot supports which are slidably attached to the supporting base with wheels or rollers or other pivotal structures for allowing the elliptical exercise machine to be moved in an elliptical moving stroke. The typical elliptical exercise machines each comprise an adjustable structure for allowing the elliptical exercise machine to be adjusted to different moving strokes.

However, the adjustable structures of the elliptical exercise machines include a motorized or complicated configuration that may not be easily operated by different users.

The present invention has arisen to mitigate and/or obviate the afore-described disadvantages of the conventional elliptical exercise machines.

SUMMARY OF THE INVENTION

The primary objective of the present invention is to provide an elliptical exercise machine including an adjustable structure for allowing the elliptical exercise machine to be easily adjusted to different moving strokes and for allowing the elliptical exercise machine to be easily operated by the user.

In accordance with one aspect of the invention, there is provided an elliptical exercise machine comprising a base, a frame including a first end pivotally attached to the base with a spindle for allowing the frame to be pivoted and moved relative to the base, and including a second end for moving up and down relative to the base, the frame including two tracks, a pivotal coupling device pivotally coupling the base and the frame together, a retractable device including an outer tube pivotally coupled to the base, and including an inner shaft slidably engaged in the outer tube and having a free end pivotally coupled to the pivotal coupling device for allowing the inner shaft to be moved into the outer tube when the frame is pivoted downwardly toward the base, and for allowing the inner shaft to be moved out of the outer tube when the frame is pivoted upwardly away from the base, and a latching device for latching the inner shaft to the outer tube at any selected position and for allowing the elliptical exercise machine to be easily adjusted to different moving strokes and for allowing the elliptical exercise machine to be easily operated by the user.

The pivotal coupling device includes a lever pivotally coupled between the base and the inner shaft, a seat secured to the frame, and a link pivotally coupled between the seat and the lever for pivotally coupling the base and the frame together and for allowing the frame to be limited to rotate relative to the base.

The base includes one or more beams, and the lever is pivotally coupled to the beam and pivotally coupled to the inner shaft. The frame includes a hand grip provided on the second end thereof for being grasped and held by a user and for allowing the frame to be pivoted or moved up and down relative to the base.

The latching device includes a bracket secured to the inner shaft and moved in concert with the inner shaft, and a pawl pivotally coupled to the bracket with a pivot pin for selectively engaging with the outer tube and for selectively positioning the pawl and the bracket and the inner shaft to the outer tube.

The bracket may be secured to the inner shaft with a bar, and the outer tube includes a slot formed therein for slidably receiving the bar and for limiting the inner shaft to slide relative to the outer tube and for allowing the bracket to be moved in concert with the inner shaft.

A plate is further provided and secured to the outer tube and includes at least one ratchet tooth for engaging with the pawl, or the pawl may be engaged with the ratchet tooth for positioning the bracket and thus the inner shaft to the outer tube at the selected position.

A first stop and a second stop are further provided and secured to the plate, and the pawl includes an extension extended outwardly therefrom for selectively engaging with either of the first and the second stops which may force the pawl to rotate relative to the bracket.

A spring member is further provided and engaged between the pawl and the bracket for maintaining the pawl either in engagement with or in disengagement from the plate, and the extension of the pawl is engageable with the first stop for disengaging the pawl from the plate and for curing the spring member downwardly, and is engageable with the second stop for forcing the pawl to engage with the plate and for curing the spring member upwardly.

A wheel is further provided and rotatably attached to the base and includes an outer peripheral portion, and a pair of arms each include a front portion pivotally coupled to the outer peripheral portion of the wheel and each include a rear portion slidably engaged with the tracks of the frame. A foot pedal is further provided and pivotally coupled to each of the arms with a pivot pole.

The base includes a column extended upwardly therefrom, a pair of handles each include a middle portion attached to the column with an axle for allowing the handles to be swung relative to the column of the base, and each include a hand grip for being held by a user, and each include a lower portion pivotally coupled to a front portion of a foot support which includes a rear portion, and the foot pedal may be pivotally attached to the rear portion of the foot support.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
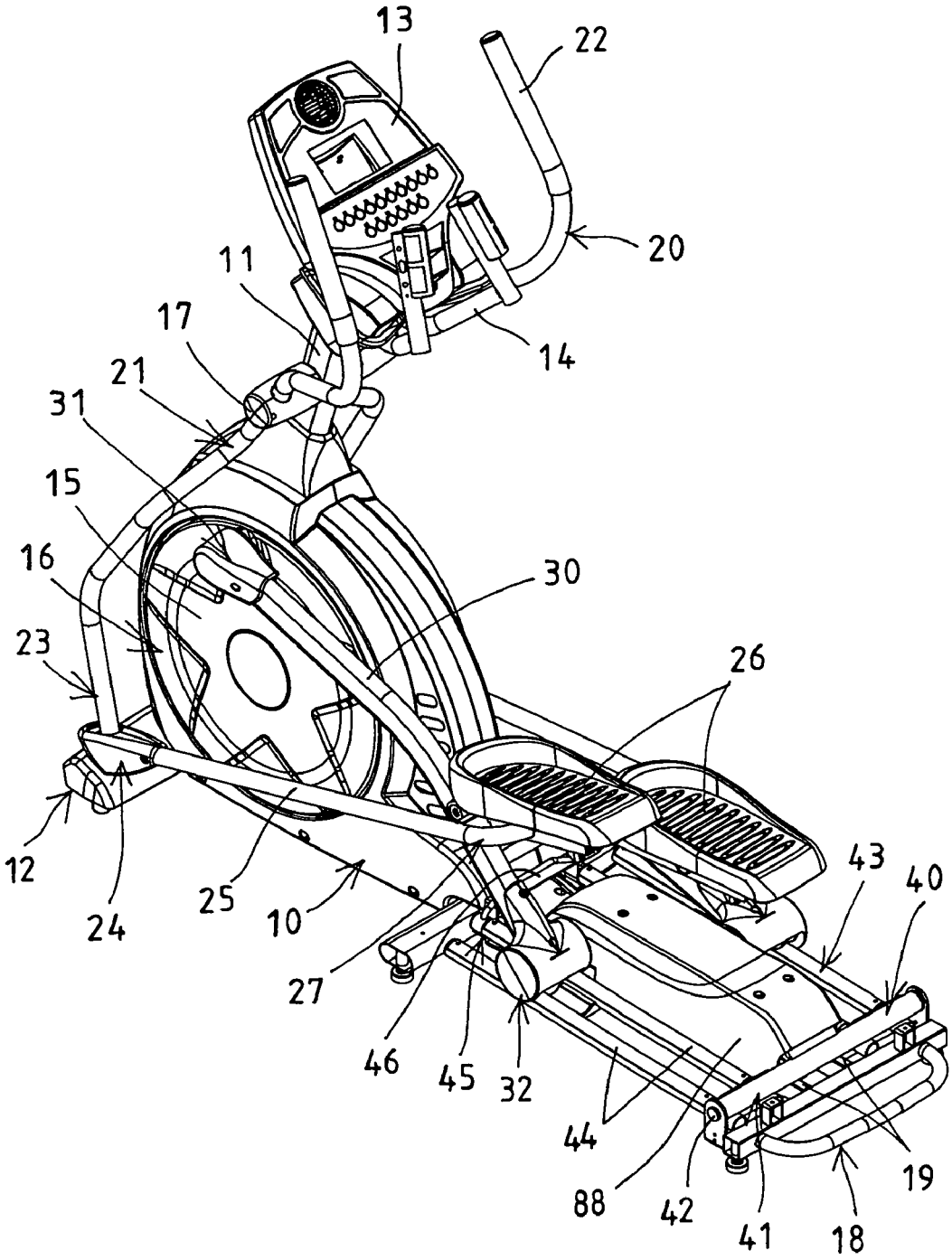
FIG. 1 is a rear perspective view of an elliptical exercise machine in accordance with the present invention.
Figure 2:
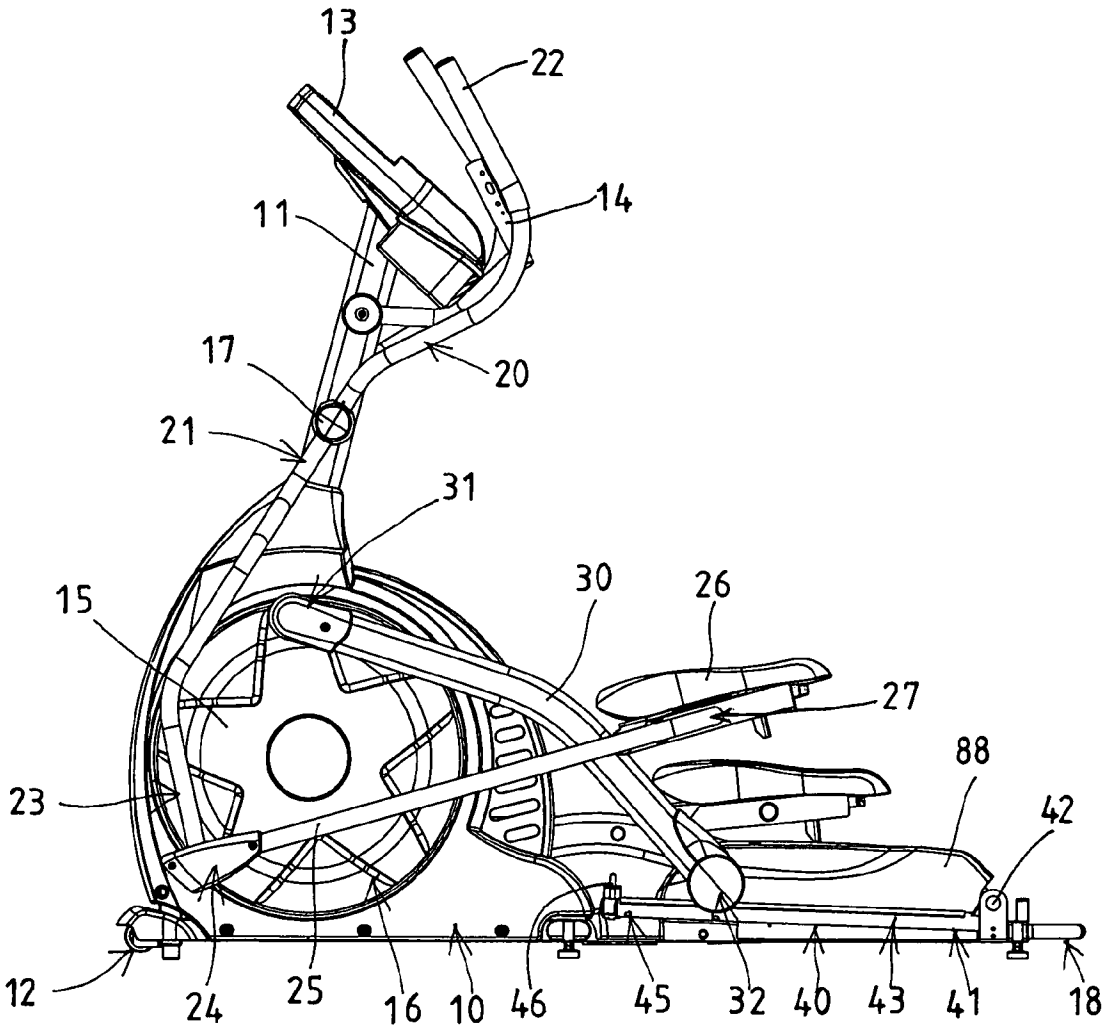
FIG. 2 is a side plan schematic view of the elliptical exercise machine
Figure 3:
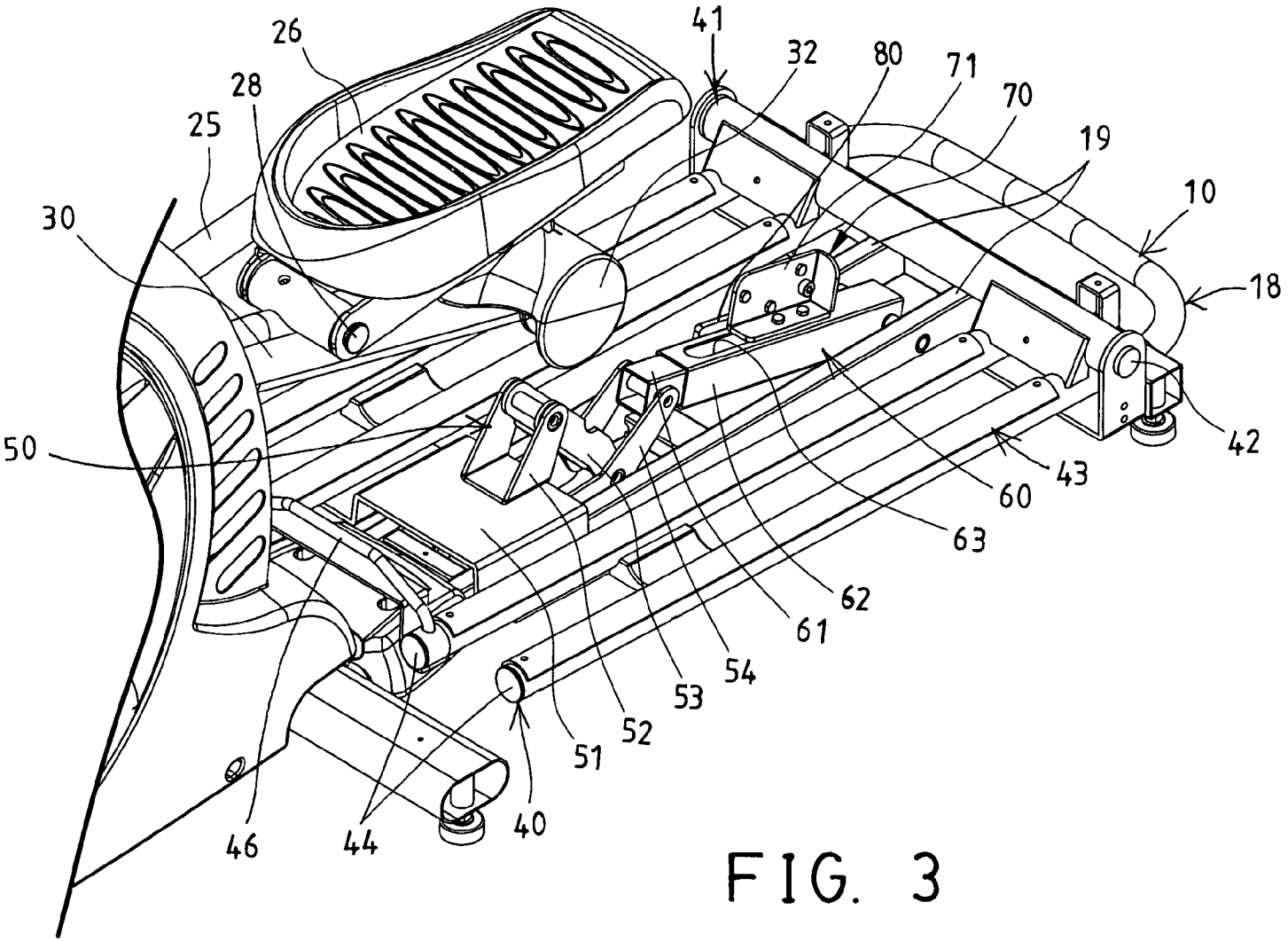
FIG. 3 is a partial front perspective view of the elliptical exercise machine.
Figure 4:
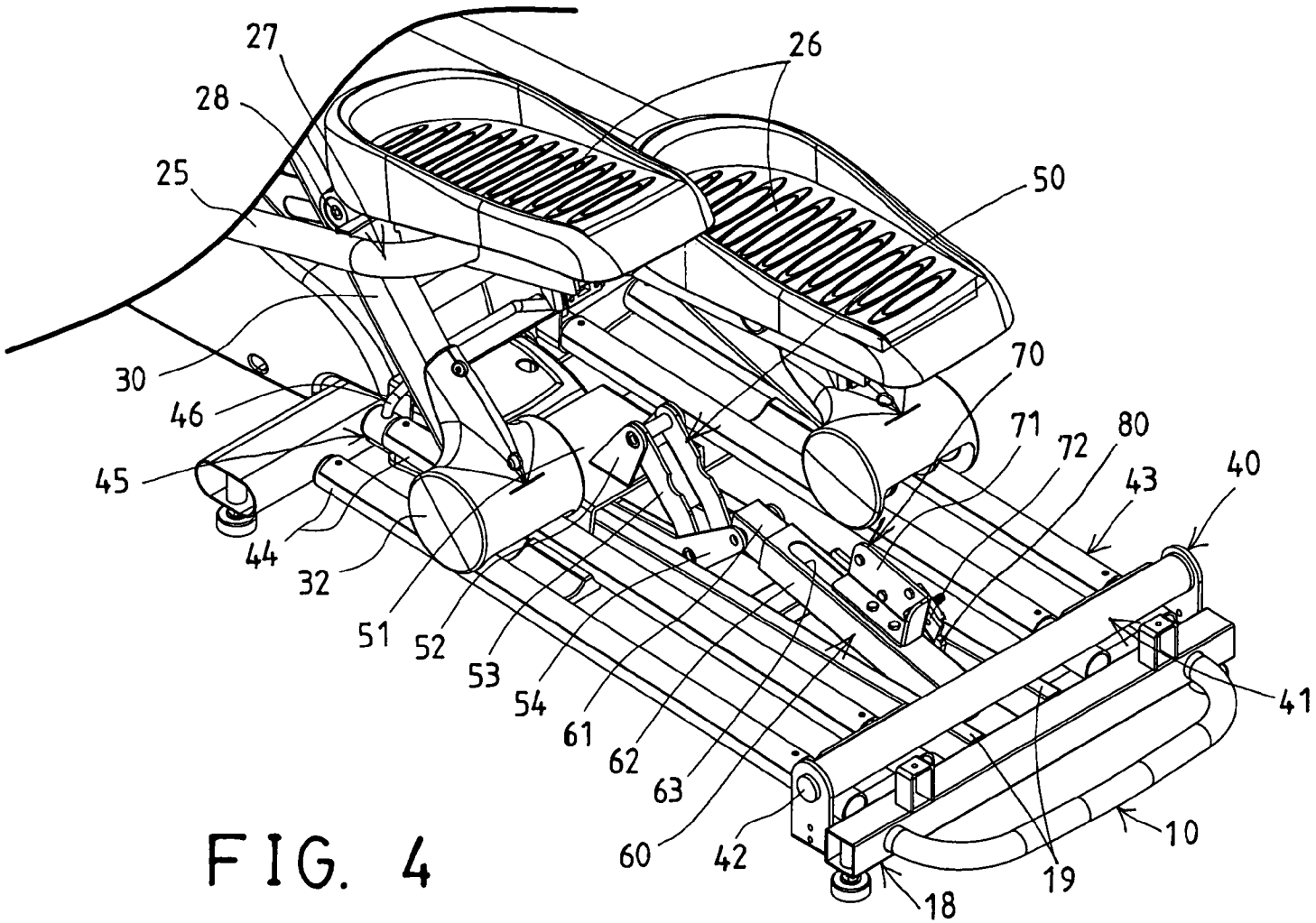
FIG. 4 is a partial rear perspective view of the elliptical exercise machine.
Figure 5:
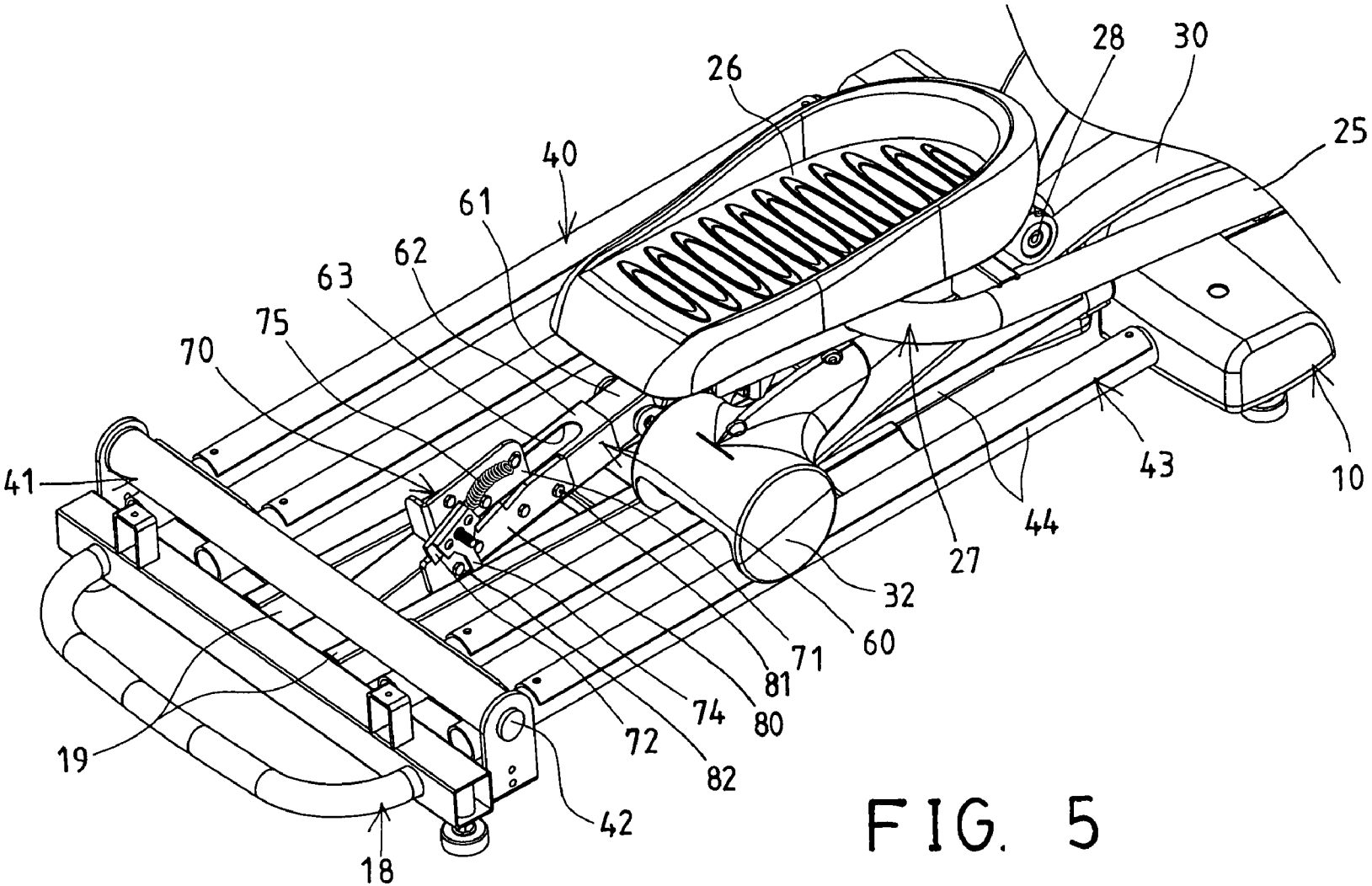
FIG. 5 is another partial rear perspective view of the elliptical exercise machine as seen from the other direction of that shown in FIG. 4.

Referring to the drawings, and initially to FIGS. 1 and 2, an elliptical exercise machine in accordance with the present invention comprises a stationary or supporting base 10 including a column 11 extended upwardly therefrom, such as extended upwardly from one end or the front portion 12 of the supporting base 10, and including a control panel or control device 13 and/or one or more (such as two) auxiliary hand grips 14 disposed on top of the column 11, and including a wheel 15 rotatably attached or supported on the supporting base 10, and the wheel 15 includes an outer peripheral portion 16.

A pair of or two handles 20 each include an upper or middle portion 21 attached or secured to the column 11 with an axle 17 for allowing the handles 20 to be pivotally coupled to the column 11 with the axle 17 and for allowing the handles 20 to be pivoted or swung relative to the column 11 of the base 10, and a hand grip 22 provided or extended upwardly from the upper or middle portion 21 of the handle 20 for being grasped or held or operated by the users, and the handles 20 each include a lower portion 23 for pivotally coupling to a front portion 24 of a foot support 25 which includes a foot pedal 26 pivotally attached or secured or coupled to the rear portion 27 of the foot support 25.

A pair of or two arms 30 each include an upper or front portion 31 rotatably or pivotally attached or secured or coupled to the outer peripheral portion 16 of the wheel 15 for allowing the front portion 31 of the arms 30 to be pivoted or rotated cyclically around the wheel 15, and each include a lower or rear portion 32. The foot pedals 26 are pivotally attached or secured or coupled to the middle portions of the arms 30 with pivot poles 28 respectively. A frame 40 include a rear portion or a first end 41 pivotally attached or secured or coupled to the rear portion 18 of the supporting base 10 with a spindle 42 for allowing the frame 40 to be pivoted or rotated relative to the supporting base 10, and the supporting base 10 includes one or more (such as two) beams 19 longitudinally provided or disposed between the front portion 12 and the rear portion 18 of the supporting base 10.

Figure 6:
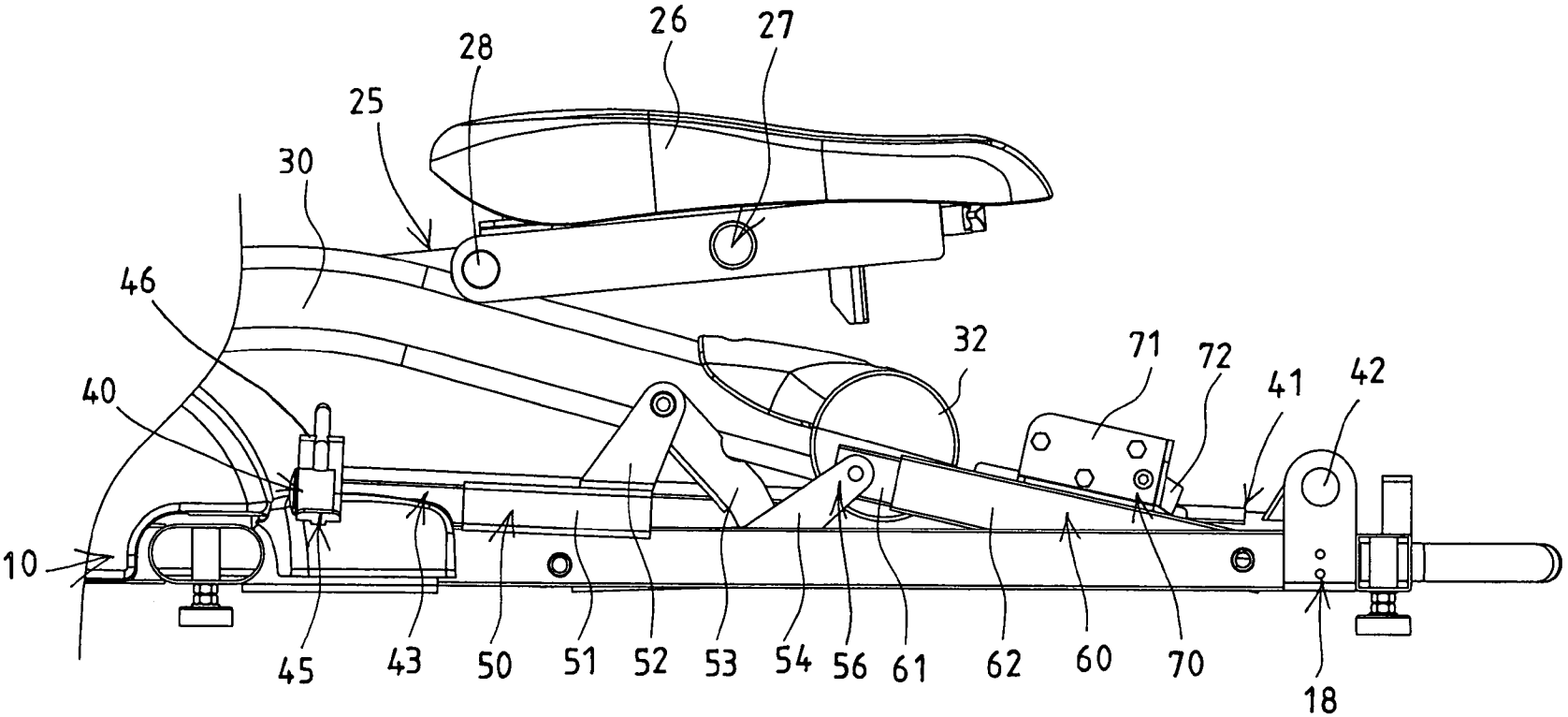
FIGS. 6, 7 are partial side plan schematic view illustrating the adjusting operation of the elliptical exercise machine.
Figure 7:
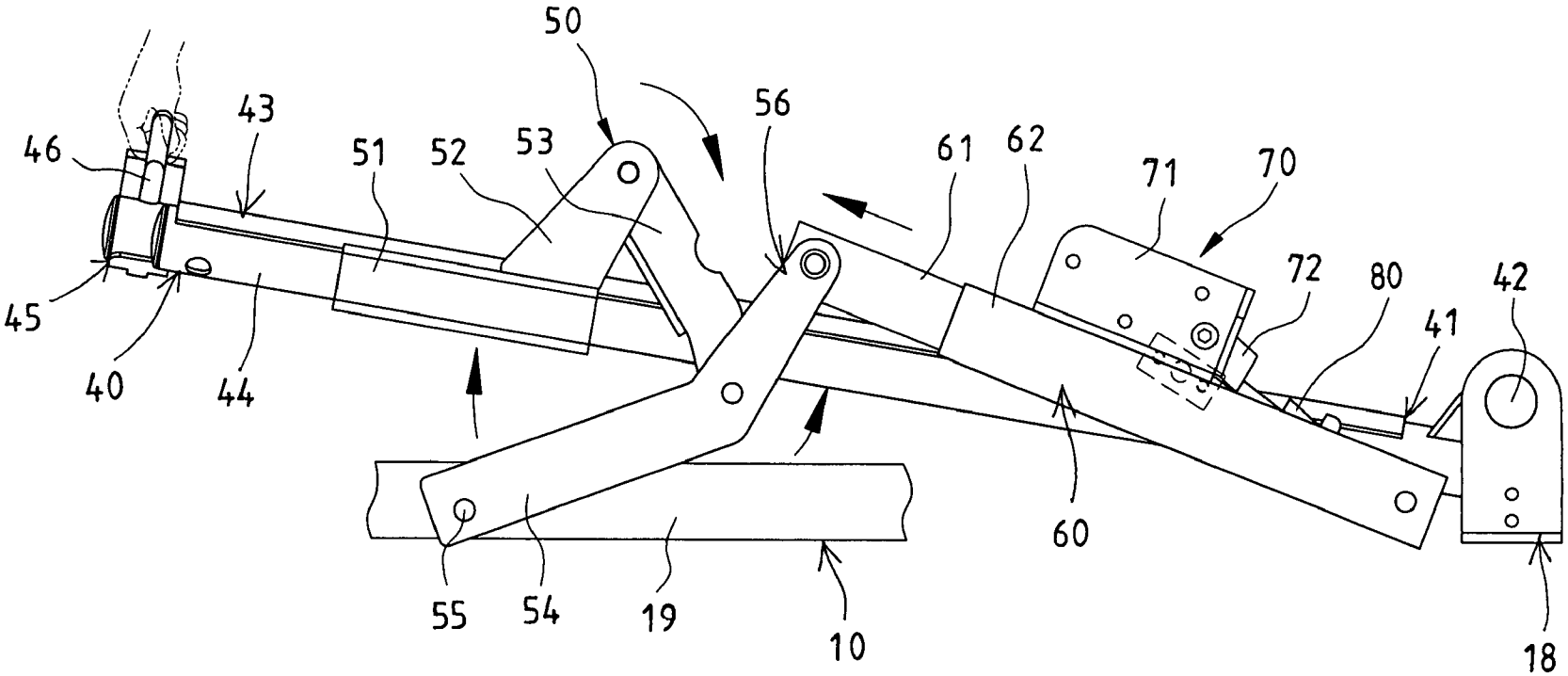

The frame 40 includes one or more (such as two) side tracks 43, and the tracks 43 each includes one or more (such as two) rods 44, and the frame 40 include a second end or a front portion 45 having a hand grip 46 provided thereon for being grasped or held or operated by the users, and for allowing the user to elevate or to move or to pivot the front portion 45 of the frame 40 up and down relative to the supporting base 10 (FIGS. 6 and 7). The rear portions 32 of the arms 30 are slidably engaged with the rods 44 or the tracks 43 of the frame 40, such that the rear portions 32 of the arms 30 may also be moved or pivoted or adjusted up and down relative to the supporting base 10 together with the frame 40, and such that the moving stroke of the foot pedals 26 may be adjusted.

As shown in FIGS. 3-7, a linking or pivotal coupling means or device 50 is provided for pivotally coupling the supporting base 10 and the frame 40 together, and includes a bracket or seat 51 attached or secured to the frame 40, a stud 52 extended upwardly from the seat 51, one or more (such as two) links 53 pivotally coupled to the stud 52 and also pivotally coupled to one or more (such as two) levers 54 respectively, the levers 54 each include a lower or front portion pivotally coupled to the base 10, such as pivotally coupled to the beams 19 of the base 10 with a pivot pin 55, and each include an upper or rear portion 56 for pivotally coupling a retractable means or device 60.

The retractable device 60 includes an inner shaft 61 slidably engaged in an outer tube 62 and having a free end or outer end pivotally coupled to the rear portion 56 of the levers 54 for allowing the inner shaft 61 to be moved into the outer tube 62 by the levers 54 when the levers 54 and the frame 40 are rotated or pivoted downwardly toward the base 10 (FIG. 6), and for allowing the inner shaft 61 to be moved out of the outer tube 62 by the levers 54 when the levers 54 and the frame 40 are rotated or pivoted upwardly away from the base 10 (FIG. 7), and the levers 54 may be rotated or pivoted upwardly away from the base 10 by the pivotal coupling device 50 when the front portion 45 of the frame 40 is elevated or moved up relative to the base 10 with the hand grip 46 of the frame 40. The outer tube 62 also include a lower or rear portion pivotally coupled to the base 10, such as pivotally coupled to the beams 19 of the base 10 (FIG. 3), and the outer tube 62 includes a longitudinal slot 63 formed in the upper portion of the outer tube 62 for allowing the inner shaft 61 to be reached or to be seen through the slot 63 of the outer tube 62.

An anchoring or latching means or device 70 is provided for anchoring or latching the inner shaft 61 to the outer tube 62 at the required or predetermined or selected relative position, and includes a bracket 71 which is secured to the inner shaft 61 with a bar 64 (FIGS. 9-11) and one or more fasteners 65 (FIGS. 8-13), and the bar 64 is slidably engaged through the slot 63 of the outer tube 62 for limiting the inner shaft 61 to slide relative to the outer tube 62 and for allowing the bracket 71 to be moved in concert with the inner shaft 61. A catch or pawl 72 is pivotally coupled to the bracket 71 with a pivot pin 73, and includes an extension 74 extended outwardly therefrom, and a spring member 75 is attached or engaged between the pawl 72 and the bracket 71 for positioning the pawl 72 relative to the bracket 71.

As also shown in FIGS. 8-13, a plate 80 is secured to the outer tube 62 with one or more (such as two) fasteners or stops 81, 82, and includes one or more ratchet teeth 83 formed or provided on the upper portion thereof for engaging with the pawl 72 and for positioning the bracket 71 and the inner shaft 61 to the outer tube 62 at the required or predetermined relative position. A shield or covering 88 may further be provided and attached or secured to the supporting base 10 for shielding or covering the pivotal coupling device 50 and the retractable device 60 and the latching device 70 (FIGS. 1, 2) and for preventing the pivotal coupling device 50 and the retractable device 60 and the latching device 70 from being exposed and interfered by the users.

Figure 8:
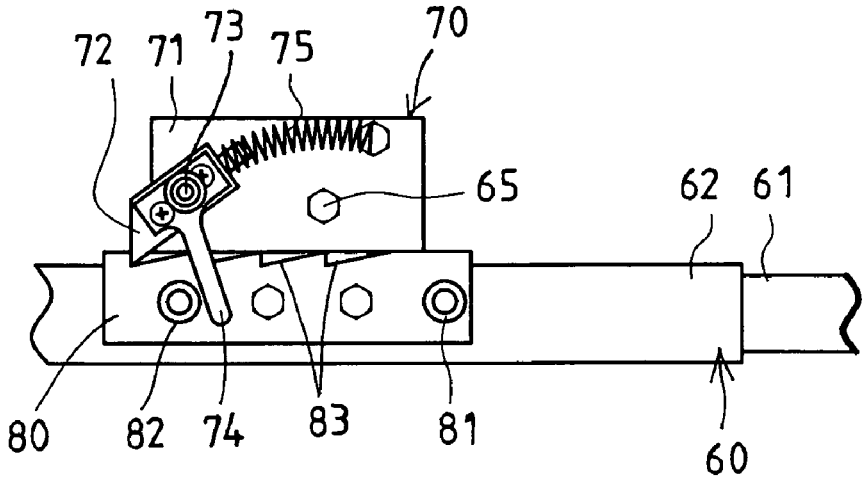
FIGS. 8, 9, 10, 11, 12, 13 are enlarged partial side plan schematic view illustrating the adjusting operation of the elliptical exercise machine.
Figure 9:
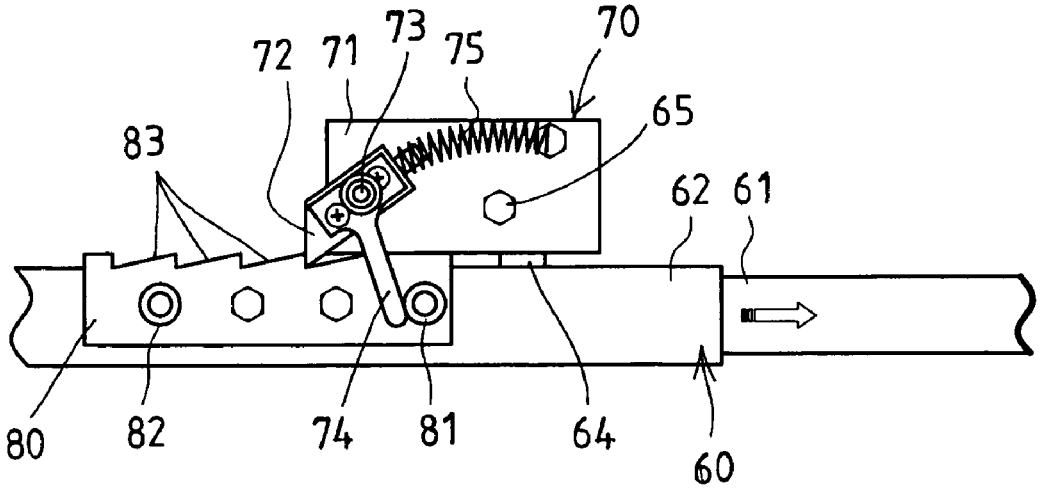
Figure 10:
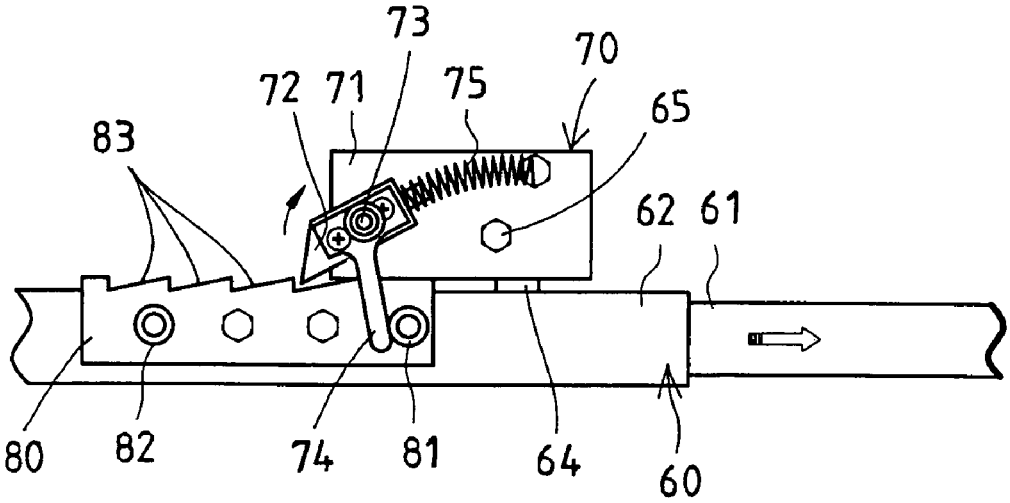

In operation, as shown in FIGS. 6-13, the front portion 45 of the frame 40 may be elevated or moved or pivoted or pulled up relative to the supporting base 10 by the user with the hand grip 46 from the horizontal position as shown in FIG. 6 to the upwardly extended or inclined position as shown in FIG. 7, and the levers 54 may be rotated or pivoted upwardly away from the base 10 by the stud 52 and the links 53, and the inner shaft 61 may be moved out of the outer tube 62 by the levers 54. As shown in FIGS. 8-13, when the inner shaft 61 is moved out of the outer tube 62 from the position as shown in FIG. 8 toward the positions as shown in FIGS. 9 and 10, the pawl 72 may be biased by the spring member 75 to engage with either of the ratchet teeth 83 in order to position the bracket 71 and the inner shaft 61 to the outer tube 62 at the required or predetermined relative position and so as to position and maintain the inclined position of the frame 40 relative to the supporting base 10. At this moment, the spring member 75 is curved upwardly.

Figure 11:
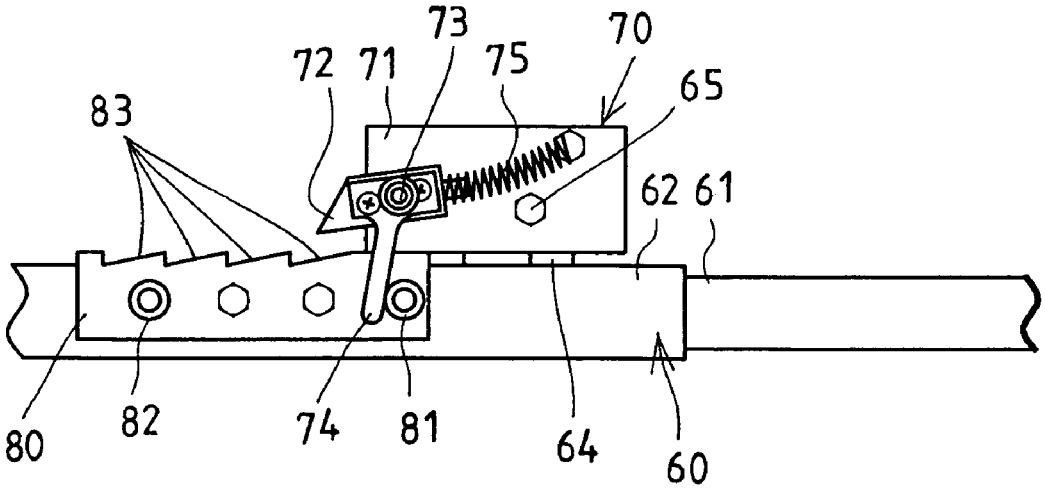
Figure 12:
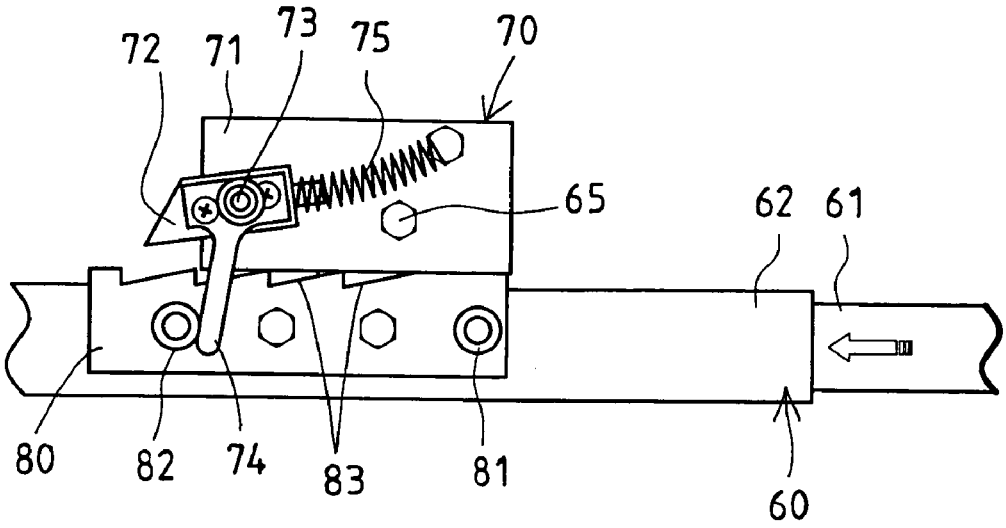

When the inner shaft 61 is further moved out of the outer tube 62 from the position as shown in FIG. 10 toward the position as shown in FIG. 11, the extension 74 of the pawl 72 may be forced to engage with the stop 81, and the pawl 72 may then be forced to rotate clockwise relative to the bracket 71 in order to bend or to curve the spring member 75 downwardly as shown in FIGS. 11-12. At this moment, the spring member 75 may bias and move and maintain the pawl 72 at the position where the pawl 72 is disengaged from the ratchet teeth 83 of the plate 80. When the pawl 72 is disengaged from the ratchet teeth 83 of the plate 80, the bracket 71 and the inner shaft 61 may no longer be latched or positioned to the outer tube 62 with the pawl 72, and the frame 40 may be moved or pivoted down relative to the supporting base 10 by the gravity force in order to force and move the inner shaft 61 into the outer tube 62.

Figure 13:
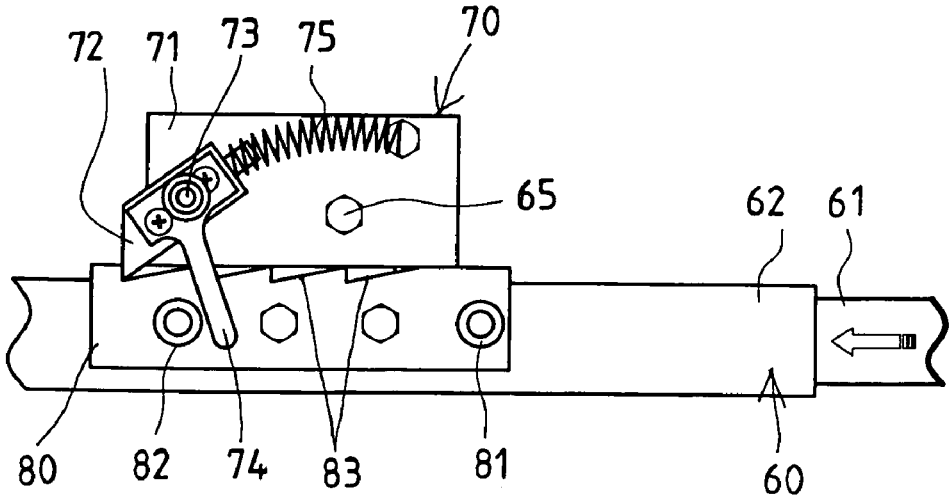

When the inner shaft 61 is further moved into the outer tube 62 from the position as shown in FIG. 12 toward the position as shown in FIG. 13, the extension 74 of the pawl 72 may be forced to engage with the other stop 82, and the pawl 72 may then be forced to rotate counterclockwise relative to the bracket 71 in order to bend or to curve the spring member 75 upwardly as shown in FIG. 13. At this moment, the spring member 75 may bias and force the pawl 72 to engage with the ratchet teeth 83 of the plate 80 again, in order to bias and force the pawl 72 to engage with either of the ratchet teeth 83 of the plate 80 again, and so as to position and latch the inner shaft 61 to the outer tube 62 at the required or predetermined position when the inner shaft 61 is moved out of the outer tube 62 again and when the front portion 45 of the frame 40 is elevated or moved or pivoted or pulled up relative to the supporting base 10 by the user again.

Accordingly, when it is required to change the inclination of the frame 40 relative to the base 10, it is only required to elevate or move or pivot or pull the front portion 45 of the frame 40 relative to the supporting base 10, and the pawl 72 may be biased and forced to engage with either of the ratchet teeth 83 of the plate 80 in order to position the bracket 71 and the inner shaft 61 to the outer tube 62 at the required or predetermined relative position and so as to position and maintain the inclined position of the frame 40 relative to the supporting base 10. The frame 40 may be moved or pivoted down relative to the supporting base 10 by the gravity force when the front portion 45 of the frame 40 is further pulled or moved upwardly relative to the supporting base 10, and when the pawl 72 is disengaged from the ratchet teeth 83 of the plate 80 and when the bracket 71 and the inner shaft 61 are not latched or positioned to the outer tube 62 by the pawl 72.

Accordingly, the elliptical exercise machine in accordance with the present invention includes an adjustable structure for allowing the elliptical exercise machine to be easily adjusted to different moving strokes and for allowing the elliptical exercise machine to be easily operated by the user.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. An elliptical exercise machine comprising: a base, a frame including a first end pivotally attached to said base with a spindle for allowing said frame to be pivoted and moved relative to said base, and including a second end for moving up and down relative to said base, said frame including two tracks, a hand grip attached to said frame; a pivotal coupling device pivotally coupling said base and said frame together, a retractable device including an outer tube pivotally coupled to said base, and including an inner shaft slidably engaged in said outer tube and having a free end pivotally coupled to said pivotal coupling device for allowing said inner shaft to be moved into said outer tube when said frame is pivoted downwardly toward said base, and for allowing said inner shaft to be moved out of said outer tube when said frame is pivoted upwardly away from said base, and a latching device for latching said inner shaft to said outer tube at a selected position;

wherein a wheel is rotatably attached to said base and includes an outer peripheral portion, and a pair of arms each include a front portion pivotally coupled to said outer peripheral portion of said wheel and each include a rear portion slidably engaged with said tracks of said frame;

wherein a foot pedal is pivotally coupled to each of said arms with a pivot pole; whereby the inclination of the frame can be changed by unlatching the latching device and pulling on said hand grip.

2. The elliptical exercise machine as claimed in claim 1, wherein said pivotal coupling device includes a lever pivotally coupled between said base and said inner shaft, a seat secured to said frame, and a link pivotally coupled between said seat and said lever for pivotally coupling said base and said frame together.

3. The elliptical exercise machine as claimed in claim 2, wherein said base includes a beam, and said lever is pivotally coupled to said beam.

4. The elliptical exercise machine as claimed in claim 1, wherein said latching device includes a bracket secured to said inner shaft and moved in concert with said inner shaft, and a pawl pivotally coupled to said bracket for positioning said pawl and said bracket and said inner shaft to said outer tube.

5. The elliptical exercise machine as claimed in claim 4, wherein said bracket is secured to said inner shaft with a bar, and said outer tube includes a slot formed therein for receiving said bar.

6. The elliptical exercise machine as claimed in claim 4, wherein a plate is secured to said outer tube and includes at least one ratchet tooth for engaging with said pawl and for positioning said bracket and said inner shaft to said outer tube at said selected position.

7. The elliptical exercise machine as claimed in claim 6, wherein a first stop and a second stop are secured to said plate, and said pawl includes an extension extended outwardly therefrom for selectively engaging with either of said first and said second stops.

8. The elliptical exercise machine as claimed in claim 7, wherein a spring member is engaged between said pawl and said bracket for maintaining said pawl either in engagement with or in disengagement from said plate, and said extension of said pawl is engageable with said first stop for disengaging said pawl from said plate, and is engageable with said second stop for forcing said pawl to engage with said plate.

9. The elliptical exercise machine as claimed in claim 1, wherein said base includes a column extended upwardly therefrom, a pair of handles each include a middle portion attached to said column with an axle for allowing said handles to be swung relative to said column of said base, and each include a hand grip for being held by a user, and each include a lower portion pivotally coupled to a front portion of a foot support which includes a rear portion, said foot pedal is pivotally attached to said rear portion of said foot support.

10. The elliptical exercise machine as claimed in claim 1, wherein said frame includes a hand grip provided on said second end thereof for being grasped and held by a user.

* * * * *